US005305719A

United States Patent [19]

Clarke et al.

[11] Patent Number: 5,305,719

[45] Date of Patent: Apr. 26, 1994

[54] ENGINE CAMSHAFT DEACTIVATION MECHANISM

[75] Inventors: James R. Clarke; Roy E. Diehl, both of Northville; Aladar O. Simko, Dearborn Heights, all of Mich.

[73] Assignee: Ford Motor Company, Dearborn, Mich.

[21] Appl. No.: 85,889

[22] Filed: Jul. 6, 1993

[51] Int. Cl.[5] ..... F01L 1/12; F02D 13/06

[52] U.S. Cl. ..... 123/90.17; 123/90.31; 123/198 F; 74/568 R; 192/48.3; 192/48.7

[58] Field of Search ..... 123/90.15, 90.17, 90.31, 123/198 F; 74/567, 568 R; 192/48.1, 48.3, 48.7

[56] References Cited

U.S. PATENT DOCUMENTS

| | | | |
|---|---|---|---|
| 4,389,985 | 6/1983 | Huber et al. | 123/198 F |
| 4,394,854 | 7/1983 | Huber | 123/198 F |
| 4,555,003 | 11/1985 | Phillips | 123/198 F |
| 4,627,391 | 12/1986 | Derringer | 123/90.16 |
| 4,722,308 | 2/1988 | Wall | 123/198 F |
| 4,754,727 | 7/1988 | Hampton | 123/90.17 |
| 4,794,893 | 1/1989 | Masuda et al. | 123/90.17 |
| 5,172,661 | 12/1992 | Brune et al. | 123/90.17 |
| 5,172,662 | 12/1992 | Hampton | 123/90.17 |

*Primary Examiner*—E. Rollins Cross
*Assistant Examiner*—Weilun Lo
*Attorney, Agent, or Firm*—Jerome R. Drouillard; Roger L. May

[57] ABSTRACT

Several embodiments of an automotive engine camshaft deactivator that smoothly disconnect and reconnect a camshaft from the engine driveshaft with a low level impact force between the parts, the connection being made through a slippage friction clutch type mechanism that engages the two members in a manner providing slippage therebetween while the camshaft is being brought up to speed, whereby the camshaft lags behind the drive sprocket allowing the drive sprocket to cam a locking pin into a positive engagement relationship between the camshaft and crankshaft.

10 Claims, 5 Drawing Sheets

ENGINE CAMSHAFT DEACTIVATION MECHANISM

FIELD OF THE INVENTION

This invention relates in general to a motor vehicle type engine, and more particularly, to one of the V type having spaced banks of engine cylinders, each with their own separate camshaft. It further relates to mechanisms for coupling or uncoupling at least one of the camshafts from the others, for fuel economy and emission improvement.

BACKGROUND OF THE INVENTION

With high Federal CAFE requirements and a desire to reduce pollution, fuel economy in a vehicle becomes ever more important. A known technique of improving fuel economy and reducing emission output is to deactivate half of the engine cylinders by deactivating the corresponding valves during part load engine operation when the output requirement is low. V6, V10 and some other overhead valve engine configurations have dual banks of cylinders, each with their own camshafts, and a firing order such that the firing alternates from bank to bank.

The invention provides on these types of OHC engines an alternative method of valve train deactivation by the selective uncoupling of one of the camshafts of one of the banks from the engine driven crankshaft sprocket during part load engine operation. The operating strategy includes startup on half the cylinders down to ambient temperature levels where half the cylinders can still sustain engine operation.

DESCRIPTION OF THE PRIOR ART

It is known in the prior art to provide devices and apparatus for deactivating half of the engine cylinders to improve fuel economy. Usually, this is accomplished by splitting the crankshaft into two portions, and activating or deactivating one of the portions at low loads, or as desired. In these cases, in general, each of the crankshaft sections has its own camshaft so that the camshaft is deactivated along with the particular crankshaft section. Other prior art devices disable the valves by selectively moving the cams to inoperative positions out of contact with the valves.

None of the prior art describes or teaches a camshaft deactivator in which the camshaft per se is uncoupled from the engine crankshaft driven camshaft drive member to reduce the number of engine cylinders providing power during a particular time.

An example of the above type prior art, for example, is Phillips U.S. Pat. No. 4,555,003, which describes a split crankshaft engine for engaging and disengaging selective engine cylinders from the crankshaft to provide for either a two or four cylinder drive. A clutch mechanism 18 selectively connects or disconnects the sections. Each section has its own camshaft, which is disabled when the cylinder section is disabled. The clutch mechanism is of the positive type, and shows a tapered channel or ramp 86 in FIG. 8 for a pin 50 to follow before going into a hole for synchronizing the clutch engagement. It also shows a friction clutch 44,46 for bringing the speed of the two clutch elements near synchronization so that the pins 50 and 52 can be inserted to connect both crankshaft sections together.

Huber U.S. Pat. No. 4,394,854 and Huber et al. U.S. Pat. No. 4,389,985, also shows two crankshaft sections, each with its own camshaft, the sections either being connected for a four cylinder drive, or disconnected for a two cylinder drive. The left hand crankshaft and camshaft are continuously driven. An accelerating friction clutch is located between the camshafts to bring the deactivated camshaft up to speed and through gearing the crankshaft, prior to positive engagement of a jaw type clutch to connect the two sections together.

BRIEF SUMMARY OF THE INVENTION

The invention is directed to a number of mechanisms for coupling and uncoupling a camshaft from the engine crankshaft driven camshaft drive member. In one embodiment, the drive member and the camshaft are initially connected by a friction clutch to rotate the members together at the same rpm. Subsequently, a slippable clutch is engaged in response to a simultaneously timed release of the first friction clutch to slip rotate the camshaft to move a locking pin along a ramp-like cam surface until the proper phase crank angle is achieved, at which point the locking pin or knob locks the camshaft and crankshaft drive member together.

In a second embodiment, a spring engaged friction clutch engages the crankshaft driven drive member against a torque plate operatively connected to the camshaft by a clock-like windup spring allowing slippage between the torque plate and camshaft until a locking pin is cammed into a locking cavity to positively connect the drive member and camshaft.

In a third embodiment, a pair of similar essentially identical slippable friction clutch assemblies are employed, one for coupling the camshaft to the crankshaft driven drive member, the other for stopping rotation of the camshaft by coupling it to the engine cylinder head. In each case, a locking pin moves along a ramp-like or contoured surface into a cavity to positively lock the crankshaft driving member and camshaft together.

It is, therefore, a primary object of the invention to provide an automotive type engine with a camshaft deactivator or decoupling mechanism that smoothly recouples the camshaft to the engine crankshaft through the use of friction clutch means including slipping clutch means to smoothly raise the camshaft near that of the speed of the crankshaft driven member for a subsequent positive locking engagement between the members at the proper engine phase crank angle.

Other objects, features and advantages of the invention will become more apparent upon reference to the succeeding, detailed description thereof, and to the drawings illustrating the preferred embodiments thereof.

DESCRIPTION OF THE PREFERRED EMBODIMENTS

Figure 1:
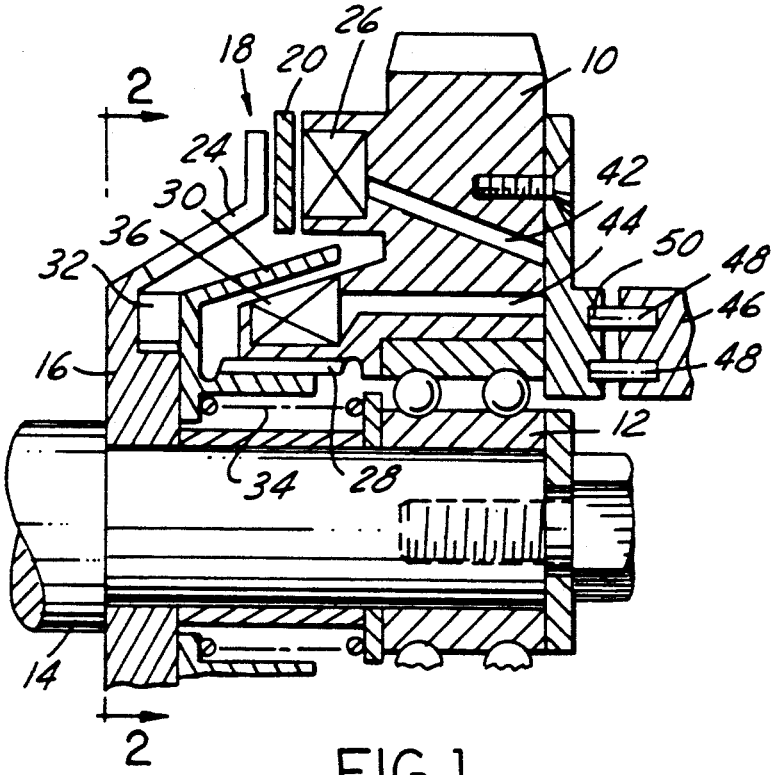
FIG. 1 illustrates schematically a cross-sectional view of a camshaft deactivation mechanism embodying the invention.

FIG. 1 shows a first embodiment of the invention in which a friction clutch is used to initially accelerate the camshaft to the speed of the crankshaft driven sprocket wheel, followed by a release of that clutch and a simultaneous phased lockup of the camshaft and sprocket through the use of an additional slippage type clutch.

More particularly, FIG. 1 shows a driving sprocket member 10 adapted to be connected to the engine crankshaft by any suitable means, not shown, such as a chain drive, for example. A roller bearing 12 rotatably supports the sprocket wheel upon an axially located camshaft 14 having a drive plate 16 fixed thereto and extending radially therefrom.

Figure 2:
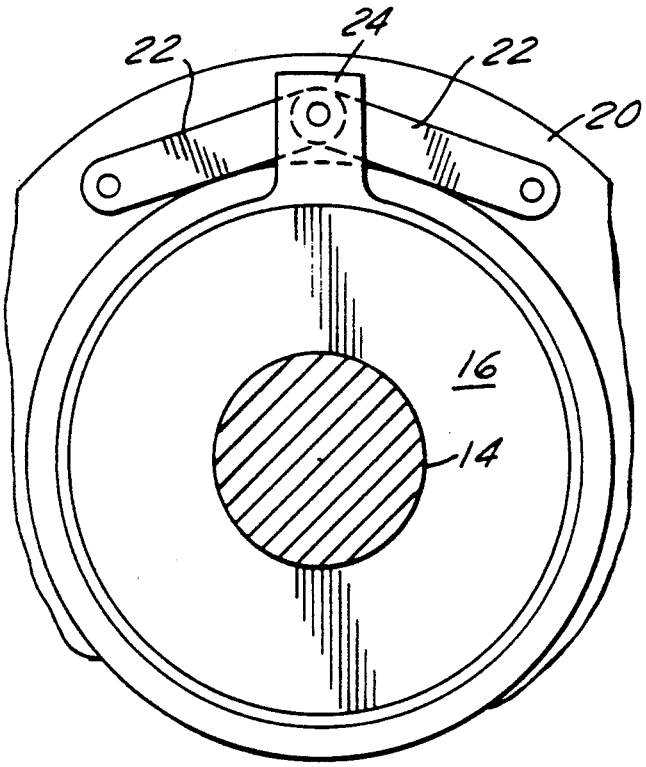
FIG. 2 is a cross-sectional view taken on a plane indicated by and viewed in the direction of the arrows II—II of FIG. 1.

The drive plate forms part of a friction disc assembly 18 that includes a clutch plate or disc 20 secured by a number of flat spring fingers 22 projecting from the plate, as shown more clearly in FIG. 2. The flat springs normally bias the plate away from an engaging position.

The drive sprocket 10 includes an electromagnetic coil 26 for controlling the engagement and disengagement of friction clutch 18 by movement of plate 20 against an extension of the sprocket wheel.

Slidably splined to sprocket 10 at 28 is an axially movable coupling disc 30 having a drive knob or tooth-like element 32 protruding laterally therefrom. The coupling disc is loaded towards the drive plate 16 by a spring 34, energization of an electromagnetic coil 36 withdrawing the disc towards the right in FIG. 1 to a disengaged position.

Figure 3:
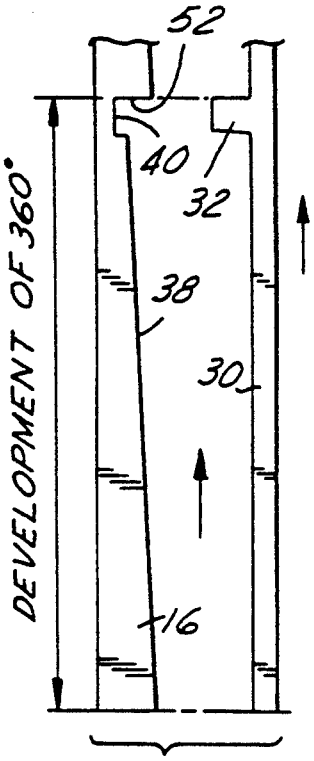
FIG. 3 is a cross-sectional view, taken out of position, of details of FIG. 1.
Figure 5:
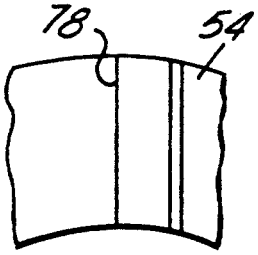
FIGS. 5 and 6 are cross-sectional views taken on planes indicated by and viewed in the direction of the arrows V—V and VI—VI, respectively.
Figure 6:
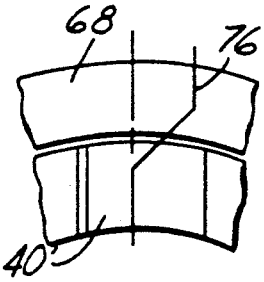

As best seen in FIG. 3, the drive plate 16 is provided with a sloping surface or ramp 38 ending in a locking cavity or receptacle 40. The ramp and receptacle cooperate with the drive knob 32 on coupling disc 30 to provide a positive drive between the camshaft and drive sprocket in properly phased relationship when the drive knob engages in the receptacle 40.

Completing the construction, sprocket 10 is supplied with current through a pair of electrical wire conducting conduits 42,44 connected at one end to coils 26 and 36, and at their other ends to a stationary connector block 46. The block incorporates two carbon brushes 48 interfacing with two copper rings 50.

A technical challenge in the design of the coupling mechanism is to facilitate fast recoupling while providing for the correct phasing with the crankshaft. Electric activation for decoupling of the spring loaded coupling 30 shown in FIG. 1 has the advantage of fast response and the feasibility for timing the reactivation relative to the camshaft position. A simple coupling device that locks in with a correct phasing may be feasible; however, the impact associated with the instantaneous coupling of the rotating sprocket and the stationary camshaft may result in too high an impact force. The design shown in FIG. 1 provides for a reduced impact load at the moment when the phased lockup occurs through the use of first the friction clutch 18, and then the slippable coupling disc.

In operation, therefore, decoupling of camshaft 14 from the crankshaft driven sprocket 10 occurs by energizing coil 36 to disengage drive knob 32 from the recess or pocket 40 shown in FIG. 3 on drive plate 16. Friction clutch 18 at this time is deenergized and disengaged.

Recoupling of the camshaft to the drive sprocket occurs by first engaging friction clutch 18 by energizing coil 26. This immediately causes camshaft 14 to rotate at the same rpm or speed as sprocket 10. However, the camshaft 14 is not yet properly phased with respect to the crank angle of the crankshaft. Therefore, coil 36 now is deenergized permitting spring 34 to push coupling disc 30 into frictional engagement with drive plate 16 attached to camshaft 14. Friction clutch 26 now is released. The spring 34 is designed to impart a low level frictional drive torque to the disc 16, but is not strong enough to drive it synchronously with sprocket 10. Therefore, the camshaft drive disc 16 will lag behind the rotation of drive disc 30. Referring to FIG. 3, the rotation ahead of drive disc 30 relative to that of camshaft drive plate 16 causes the drive knob or tooth-like element 32 to ride on ramp 38 until it reaches the recess or receptacle 40 into which it is received and locked against a shoulder 52. The receptacle 40, therefore, allows the drive knob 32 to make a complete engagement that can transmit drive torque in both directions properly phased.

FIGS. 4 through 12 illustrate a second embodiment of the invention in which torque from a gradually wound up clock-like spring accelerates the camshaft prior to the phased lockup. More specifically, a drive sprocket 10' again is rotatably mounted on the camshaft 14' by means of a roller bearing unit 12'. In this case, a drive plate 16' is keyed and bolted to the camshaft 14'. A coupling element 54 is slidably splined at 56 to drive sprocket 10' for an axial movement towards drive plate 16', A spring 58 biases disc 54 in this direction, a coil 60 returning the disc to a disengaged position in the other direction. Current to coil 60 can be applied variably through a slide connection 62,64, and wiring conduit 66.

Figure 11:
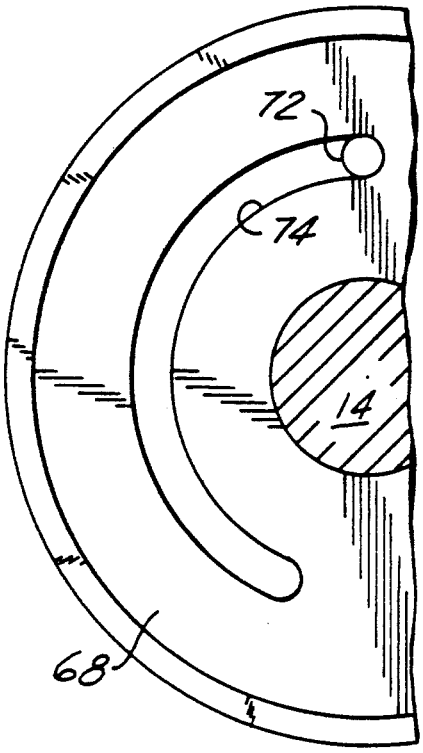
FIGS. 11 and 12 are cross-sectional views taken on planes indicated by and viewed in the direction of the arrows XI—XI and XII—XII, respectively of FIG. 4.

Connected to drive plate 16' is a torque plate 68 that is connected to the drive plate both by a clock-like windup spring 70 and a pin and circular slot type connection 72,74 shown more clearly in FIG. 11. Both the drive plate 16' and the torque plate 68 are provided with impact surfaces 76 and 78 that can receive tangential driving forces from the drive knob 80 on the face of the coupling element 54. The circular slot 74 on torque plate 16' interacts with pin 72 that is press fitted into the drive plate 16'. It allows rotation of the torque plate 68 relative to the drive plate 16' through an arc of about 160 degrees, as will be explained more fully below. When the coupling element 54 is withdrawn to the right or to the disengaged position by energizing coil 60, camshaft 14' will become disengaged or uncoupled from driving element 10'. The torque plate 68 then will be rotated (FIG. 12) by the force of the unwinding windup spring 70 to its counterclockwise limit relative to drive plate 16'. In this position, the impact surface 78 is about 160 degrees ahead or clockwise of the impact surface 80 on the drive plate 16'.

Figure 12:
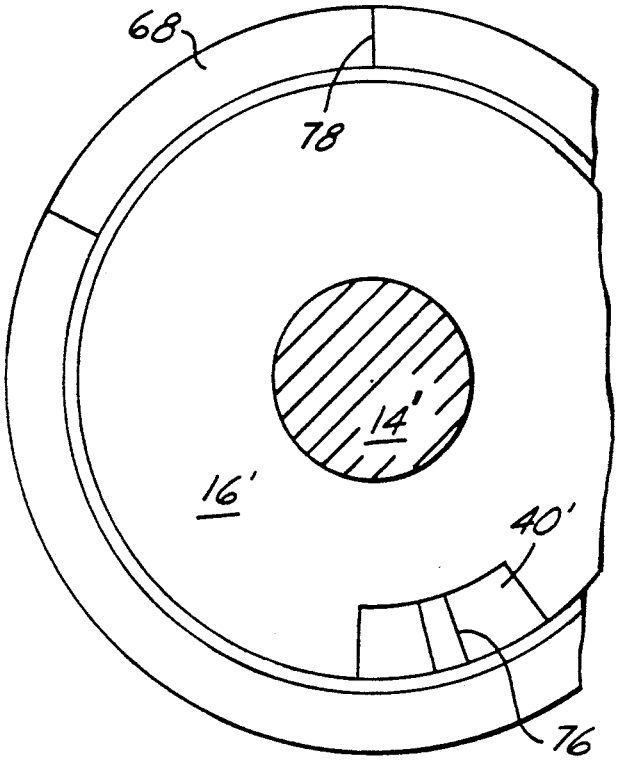

With coil 60 deenergized, coupling element 54 is forced by spring 58 towards the torque plate 68 and drive plate 16'. The drive knob 80 on the coupling element 54 will, therefore, engage the impact surface 78 of the torque plate 68 and drive it clockwise, as seen in FIG. 12. In this process, clock spring 70 is gradually wound up, and thus transmits increasing drive torque to camshaft 14', thereby accelerating it.

The spring 70 is in effect a lost motion connection, and is designed so that it imparts an initial acceleration to the camshaft, but is not strong enough to drive it synchronously with the sprocket 10'. The drive knob 80 on coupling element 54 will approach and contact the impact surface 76 on drive plate 16', resulting in a phased lockup similar to that described in connection with the FIG. 1 showing. When drive knob 80 slips fully into the recess 40', shown on FIGS. 7 and 10, it will provide a bidirectional coupling from the sprocket 10' to the camshaft 14'.

Figure 4:
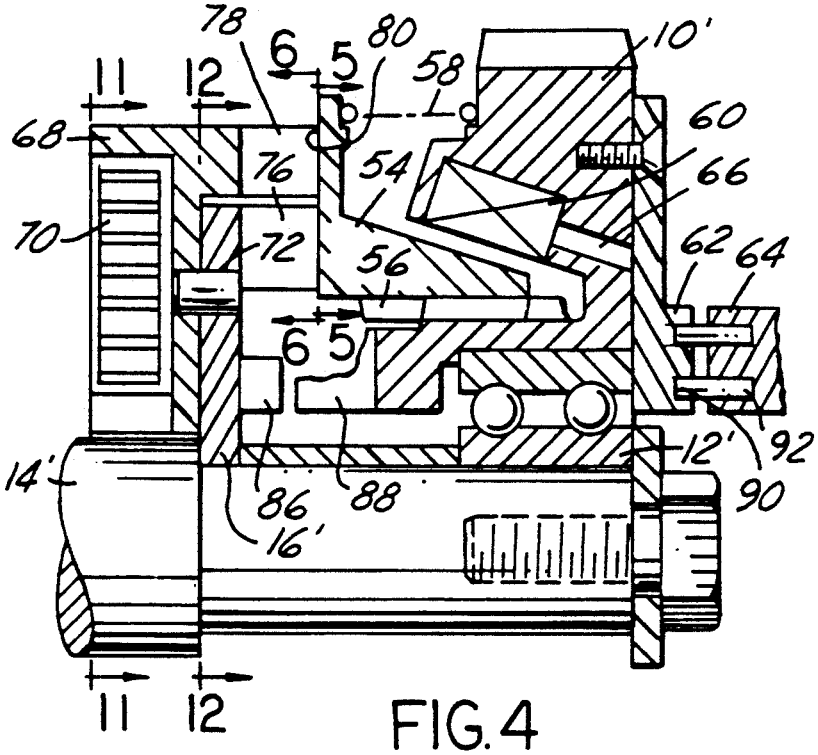
FIG. 4 illustrates schematically a cross-sectional view of a second embodiment of the invention.
Figure 10:
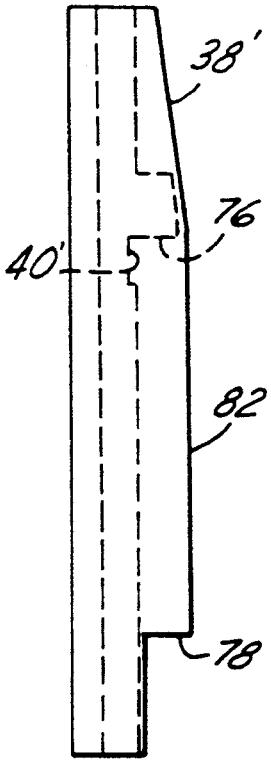
FIGS. 7 through 10 illustrate exploded and assembled details of the FIG. 4 embodiment.
Figure 7:
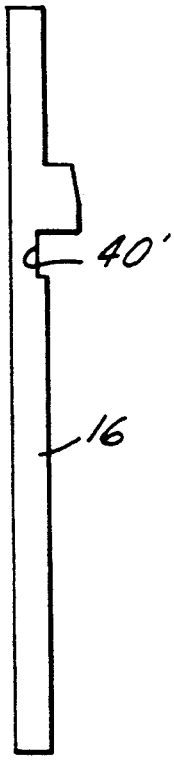
Figure 8:
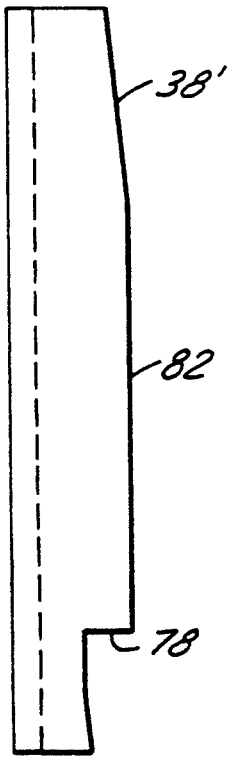
Figure 9:
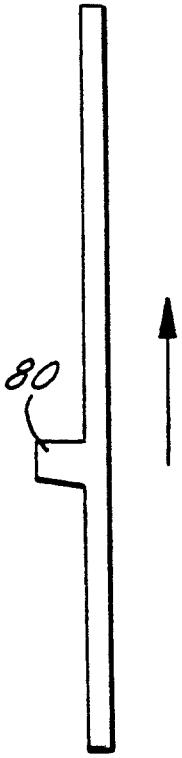

The construction shown in FIG. 4 contains features that assure a proper sequence of events in the process of recoupling. As shown in FIGS. 8 and 10, the surface 82 on torque plate 68 is formed so that when the torque plate is in its unwound or relaxed position, the drive knob 80 can only engage the impact surface 78 of the torque plate. In order for the knob 80 to engage the impact surface or shoulder 76 of drive plate 16' for phased lockup, it is necessary to fully wind up the torque plate 68 relative to the drive plate 16'. FIGS. 10 and 12 depict the two plates in relaxed position that prevails during disengagement or an uncoupling condition.

It is desirable that upon engagement, drive knob 80 should contact the largest possible surface on the impact surface 78. This can be achieved by timing the coupling release so that the drive knob 80 can slide on surface 82 and the ramp surface 38' into the position of full surface engagement. This timing is facilitated by a passive signal element 86 that is mounted on drive plate 16'', and interfaces with a sensor 88 attached to drive sprocket 10''. An electronic signal from these components can be processed so as to trigger the actual release of the coupling element at the most advantageous rotational position relative to the stationary camshaft 14'. Signal processing can be provided either within the sprocket 10' or outside the sprocket, a second sliding connection 90,92 being utilized in the latter case.

In summary, therefore, it will be seen that for reengagement of the camshaft to drive sprocket 10'', coil 60 will be disengaged or deenergized allowing spring 58 to move the coupling element 54 to engage the impact surfaces 78 and drive the torque plate 68. This together with the windup of spring 70 will accelerate drive plate 16'', Its lagging behind in rotational speed to that of the torque plate 68 causes the torque plate to move ahead of the drive plate so that the drive knob 80 moves along the ramps 82,38' and finally engages in the pocket or receptacle 40' for a positive phased lockup of camshaft 14'' and sprocket 10''.

Figure 13:
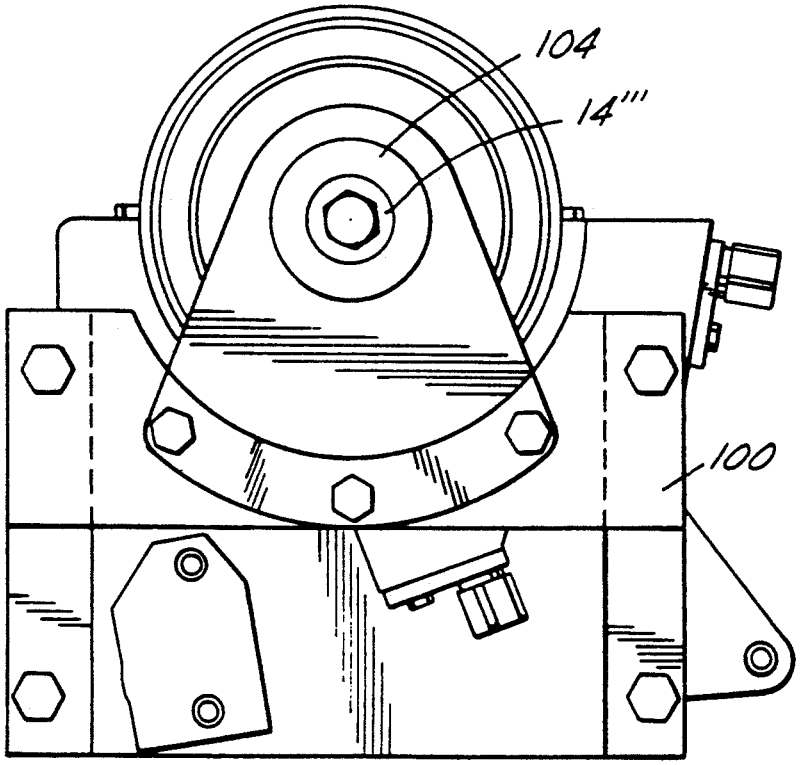
FIG. 13 is an end view, essentially to scale, of a commercially adaptive embodiment of the invention.
Figure 14:
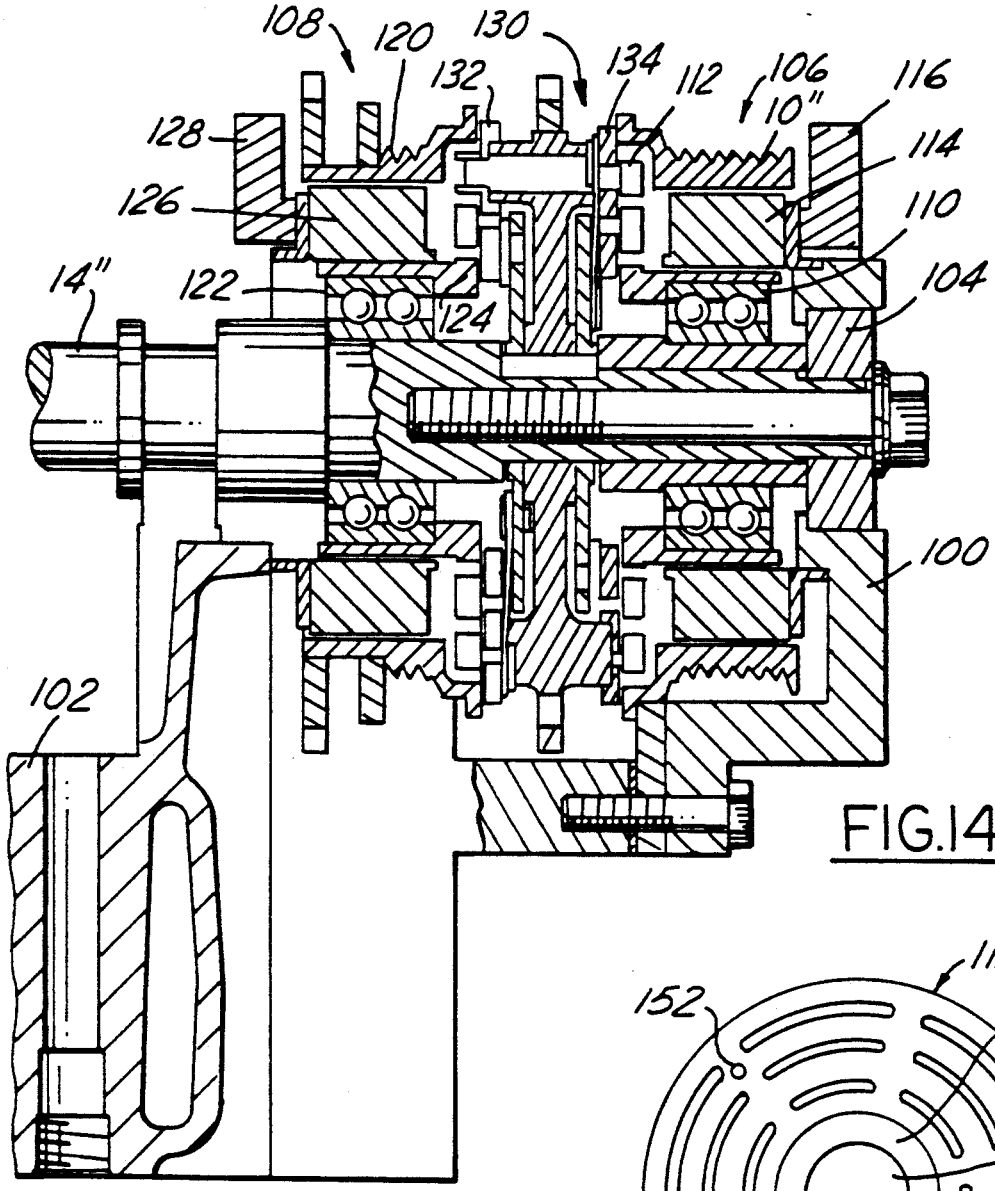
FIG. 14 is a cross-sectional view taken on a plane indicated by and viewed in the direction of the arrows XIV—XIV of FIG. 13.
Figure 16:
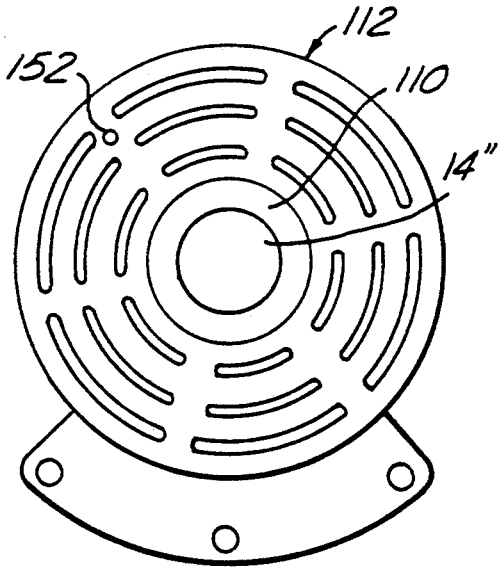
FIGS. 16 and 18 are end views of portions of the FIG. 15 showing.

FIG. 13 through 17 show a third embodiment of the invention. In this case, a pair of similar friction clutch assemblies are used to alternately connect the camshaft to the driving sprocket wheel, or to the stationary cylinder head of the engine to completely stop the rotation of the camshaft. More specifically, FIG. 13 shows an end view of a stationary housing 100 bolted as shown in FIG. 14 to the stationary engine cylinder head portion 102. Coaxially located within the housing on a bearing 104 is a camshaft 14'''. Rotatably surrounding the camshaft are a pair of pulley assemblies, a cam-drive assembly 106 and a cam-stop assembly 108. Cam-drive assembly 106 includes a sprocket wheel 10'' adapted to be chain driven from the engine crankshaft in a known manner, and rotationally mounted on the camshaft 14''' by roller bearing means 110. The pulley assembly includes a friction drive plate or disc 112 that is slotted as shown more clearly in FIG. 15, for better magnetic force transfer. Nestled within the pulley wheel is an electromagnetic coil 114 operatively connected to a source of variable current through a outlet connector 116.

The cam-stop assembly 108 is essentially a reverse image of the cam-drive assembly 106. A pulley wheel 120 is fixedly connected to the cylinder head of the engine and non-rotatably mounted on the camshaft 14''' by means of a roller bearing 122. Fixed to the pulley laterally thereof is an annular friction disc or plate 124 indicated in FIGS. 14, 15 and 18. Within the pulley wheel 120 is a second electromagnetic coil 126 operatively mounted on the housing 100 and connected electrically to a variable current source through an outlet connector 128.

Nestled between the two pulley assemblies 106 and 108 is a camshaft hub assembly 130 that is keyed to and fixedly secured to camshaft 14'''. Fixedly secured to the hub on opposite lateral sides area a pair of friction disc members 132 and 134 for cooperation with the mating friction discs 124 and 112, respectively. Discs 132 and 134 are fixed to the hub by a flat spring assembly 136 and 138 that allows for minor axial adjustments and normally biases the discs towards the hub and out of contact with the mating discs 132 and 134.

Figure 18:
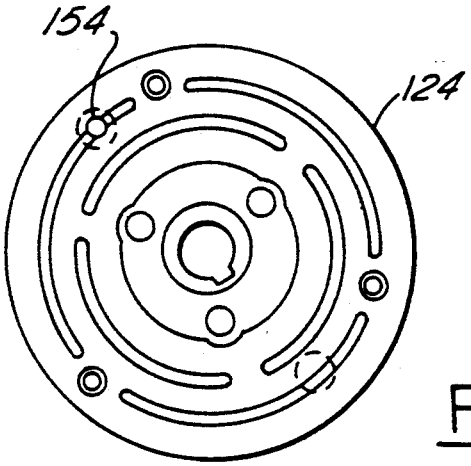
Figures 15, 17A, 17B:
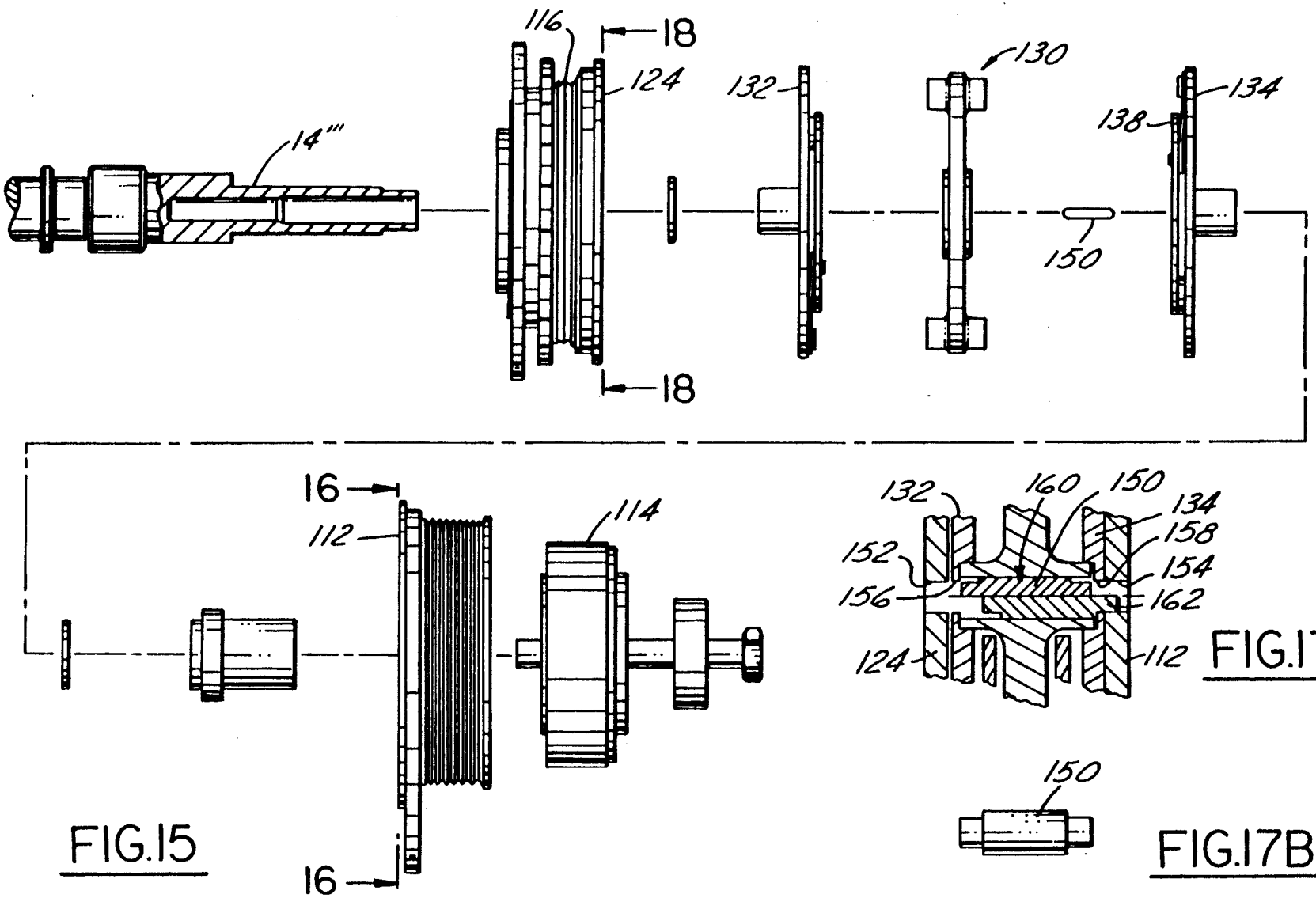
FIG. 15 is an exploded view of the FIG. 15 construction.
FIG. 17A is an enlarged cross-sectional view taken on a plane indicated by and viewed in the direction of the arrows XVIIA—XVIIA of FIG. 15.
FIG. 17B is an elevational view of a detail of the FIG. 17A showing.

The camshaft hub member assembly 130 contains a locking pin assembly for positively locking the camshaft either to drive sprocket 10''' or to the stationary sprocket wheel 120, when properly phased. For this purpose, the outer radial portion of the hub, as seen in FIG. 17A and 17B, contains a ferrous metal locking pin 150 that can be magnetically moved axially in opposite directions to lock either the friction discs 124 and 132 together, or discs 134 and 112. For this purpose, as seen in FIGS. 15 and 18, the discs 112 and 124 each have a hole 152,154 adapted to be aligned with a similar sized mating hole 156,158 in discs 132 and 134 when the phase angle is correct so that the locking pin 150 can be magnetically drawn into the holes. This is essentially the same operation as that already described in connection with the FIGS. 1 and 4 constructions to lock the discs together.

The upper half portion of pin 150 in FIG. 17A illustrates schematically a neutral position 160 of the locking pin 150 out of contact with the holes in either disc. The position of the pin in the lower portion of FIG. 17A indicates the position attained when the pin has been drawn into the hole 154 to lock the camshaft to the drive sprocket 10'''.

When it is desired to couple the camshaft to the driving sprocket 10''', coil 114 is energized or turned on with a force less than maximum that draws the camshaft clutch plate or disc 134 towards the drive disc 112. This less than full current force causes disc 134 to lag rotationally behind the drive disc 112. Simultaneously, the energization of coil 114 applies a magnetic force to the metal pin 150 urging it rightly as seen in FIG. 17A, in an attempt to enter the locking hole 154 of disc 112.

While not shown, a ramp-like surface similar to that shown in the constructions of FIGS. 1 and 3 would be provided on drive disc 112 (and also on stationary disc 124) to aid in moving the locking pin 150 at a gradually increasing speed towards the locking hole or recess 152, in a manner similar to that previously described, so that when the two mating discs 112 and 134 are nearly at the same speed, the pin can enter the hole. At the moment the pin 150 arrives at hole 154, the current from coil 114 is raised to near full strength to forcibly draw or pull the pin into the hole and lock the drive pulley 110''' positively to the camshaft 14'''. This is designed to occur within one crankshaft revolution.

Alternatively, to disengage or uncouple the camshaft from the crankshaft, coil 114 would be deenergized and coil 126 of the cam-stop assembly 128 energized. The magnetic force acting on pin 150 will immediately withdraw the pin from the hole 154 in drive disc 112 and move it to the left as seen in FIG. 17A towards engagement with the hole 152 in stationary disc 124, in a manner similar to that described in connection with the operation of the cam-drive assembly 106. The rotating camshaft and disc 132 will be rotating relative to the stationary disc 124 causing the pin 150 to move or cam down the ramp, previously mentioned but not shown, towards entry into the hole 152 to positively lock the camshaft to the stationary cylinder head 102.

From the foregoing, it will be seen that the invention provides several embodiments of a camshaft deactivating mechanism that provides for a smooth recoupling of the camshaft to the constructions, to the stationary cylinder head. This is accomplished by friction clutch means that include slippable clutches allowing one of the clutch elements to lag behind the other in rotational speed for cooperation with ramp-like surfaces and locking indentations for engagement therebetween upon proper phasing and synchronization of the parts, to thereby provide a positive engagement between the parts and yet one with a low impact force between the parts.

While the invention has been shown and described in its preferred embodiments, it will be clear to those skilled in the arts to which it pertains that many modifications and changes may be made thereto without departing from the scope of the invention.

We claim:

1. A camshaft coupling and decoupling mechanism for an automotive type engine having an engine crankshaft driven sprocket type driving element and a camshaft connected and driven thereby, the mechanism including clutch means between the sprocket element and camshaft having one and another parts, means for gradually engaging the clutch means with an initial force establishing relative rotation between the parts to provide a lagging rotation of one of the parts behind the other, and contoured surface means on a portion of the parts engageable by means on the other of the parts in response to relative rotation therebetween to effect a movement of the first mentioned one part into positive engagement with the first mentioned other part to lock the sprocket element and camshaft together for unitary movement, and means to render inoperable said clutch means to disconnect the camshaft from the sprocket element to deactivate the camshaft.

2. A mechanism as in claim 1, wherein the engine is of the V type having two banks of cylinders and a separate camshaft associated with each, a coupling apparatus associated with one of the camshafts to permit deactivation thereof thereby permitting engine operation solely in response to the cylinders associated with the camshaft of the other bank.

3. A mechanism as in claim 1, wherein the engine is of the V type having two banks of cylinders and a separate camshaft associated with each, a coupling apparatus associated with either or both of the camshafts to permit deactivation of one or the other of the camshafts thereby permitting engine operation solely in response to the cylinders associated with the camshaft of the other bank.

4. A mechanism as in claim 1, wherein the clutch means is of the electromagnetic type wherein the energizing current thereto can be varied to vary the engaging force of the clutch means.

5. A mechanism as in claim 1, wherein the clutch means is spring biased into engaging position.

6. A mechanism as in claim 1, wherein the clutch means includes tooth-like clutching elements.

7. A mechanism as in claim 1, wherein the clutch means includes a windup clock-like spring interconnecting the drive and camshaft members including a pin and slot interconnection between the members limiting relative rotation therebetween.

8. A mechanism as in claim 1, wherein the clutch means includes first slippable clutch means connectable between the drive member and camshaft, and second slippable clutch means connectable between the camshaft member and a stationary part of the engine to stop the rotation of the camshaft.

9. A mechanism as in claim 8, including electromagnetic means for engaging each of the first and second clutch means, and spring means for disengaging the clutch means.

10. A method of coupling and uncoupling an engine crankshaft driven drive member to and from a camshaft member comprising the steps of:

first providing an electromagnetically controlled friction clutch between the members for locking the members together for rotation at the same rpm, secondly, providing a second spring engaged, electromagnetically disengaged, slippable clutch means connected between the members having a tooth like drive element on the drive member cooperating with a ramp and element receptacle on the camshaft member, thirdly, engaging the friction clutch while disengaging the second clutch means to rotate the two members at the same rpm, then disengaging the friction clutch while engaging the slippage clutch with a force providing a slippage between the members and relative rotation therebetween causing the tooth like drive element to engage the ramp and subsequently enter the receptacle to positively lock the two members together, and finally, electromagnetically withdrawing the second clutch means against the spring bias to decouple the camshaft member form the drive member.

* * * * *